US008338731B2

(12) United States Patent
Yu

(10) Patent No.: US 8,338,731 B2
(45) Date of Patent: Dec. 25, 2012

(54) SWITCH ASSEMBLY HAVING REPLACEABLE SWITCH CAP

(76) Inventor: Tsung-Mou Yu, Panchiao (TW)

( * ) Notice: Subject to any disclaimer, the term of this patent is extended or adjusted under 35 U.S.C. 154(b) by 81 days.

(21) Appl. No.: 13/004,889

(22) Filed: Jan. 12, 2011

(65) Prior Publication Data

US 2012/0175233 A1 Jul. 12, 2012

(51) Int. Cl.
*H01H 3/00* (2006.01)

(52) U.S. Cl. ..... 200/339

(58) Field of Classification Search ..... 200/339, 200/341, 553, 520–526, 529–535, 557–559; 337/66

See application file for complete search history.

(56) References Cited

U.S. PATENT DOCUMENTS 5,660,270 A * 8/1997 Martin et al. ..... 200/315
5,909,020 A * 6/1999 Gallone ..... 200/438

FOREIGN PATENT DOCUMENTS

CN 2646858 10/2004

OTHER PUBLICATIONS

Cheng-An Chien et al., "A High Throughput Deblocking Filter Design Supporting Multiple Video Coding Standards," in processing of IEEE International Symposium on Circuits and Systems (ISCAS '09), May 2009.

* cited by examiner

*Primary Examiner* — Edwin A. Leon
(74) *Attorney, Agent, or Firm* — Lin & Associates IP, Inc.

(57) ABSTRACT

A switch assembly includes a base, a switch member and a switch cap. The switch member is received in a recess of the base and pivotally connected to the base. The switch member has a pressing piece which is lowered to push a bi-metallic strip in the base. The switch member has engagement portions. A switch cap has a hook unit on a bottom thereof and the hook unit includes a first hook, a second hook and a third hook. The first and second hooks are located at two opposing sides of the switch cap, and the third hook is located at another side of the switch cap. The hook unit is hooked with the engagement portions of the switch member so that the switch cap is connected to the switch member.

1 Claim, 5 Drawing Sheets

SWITCH ASSEMBLY HAVING REPLACEABLE SWITCH CAP

BACKGROUND OF THE INVENTION

1. Field of the Invention

The present invention relates generally to a switch assembly, and in particular to a switch assembly having a replaceable switch cap.

2. The Prior Arts

A conventional switch assembly generally includes a switch member having a middle portion pivotally connected to a base and a pressing piece connected to one end of the switch member. When the switch member is operated, the pressing piece pushes a conductive piece such as a bi-metallic strip to electrically contact with another conductive piece, thereby forming a closed circuit.

However, different machines or products need different shapes of switch members. Especially on a machine having multiple switches, the switch members having various shapes or colors corresponding to different functions are used. Therefore, the user can easy distinguish the switch members and does not operate the wrong ones. It needs various molds to manufacture the switch members in various shapes and therefore the manufacturers have to prepare a lot of molds. Producing molds is expensive and time consuming. The high cost for molds make the switches to be less competitive in the market.

CN 2,646,858 discloses a fuse-less switch assembly and includes a case, a switch member and a switch cap. The switch cap is connected with the switch member and the switch member has a middle portion pivotally connected with the case. The switch member includes a pressing piece to push a free end of a bi-metallic strip. The switch cap includes connection portions to be connected with connection holes of the switch member. By modularization, the case and the switch member can be made in mass production so as to be connected with the interchangeable switch caps having different shapes or colors.

Nevertheless, the connection portions and the connection holes are respectively located at two sides of the switch cap and the switch member, the connection portions tend to shift relative to the connection holes after a period of use and even disengage from the connection holes.

SUMMARY OF THE INVENTION

A primary objective of the present invention is to provide a modularized switch assembly which includes a replaceable switch cap to be hooked to a switch member and is easy to replace when needed.

In order to achieve the objective, a switch assembly according to the present invention comprises a base, a switch member and a replaceable switch cap. The base includes a recess defined therein and two pivotal holes are defined in two sidewalls of the recess.

The switch member is located in the recess and has two pivots corresponding to the pivotal holes on two sides thereof. The two pivots are pivotably engaged with the pivotal holes in the base. Thus, the switch member is capable of pivotally rotating about the pivots. A pressing piece is connected to the switch member. The switch member has a plurality of engagement portions.

The switch cap has a hook unit on a bottom thereof and the hook unit includes a first hook, a second hook and at least one third hook corresponding to the engagement portions of the switch member. The first and second hooks are disposed at two opposing sides of the switch cap, respectively. The third hook is disposed at another side of the switch cap. The hook unit is engaged with the engagement portions of the switch member.

According to the present invention, the switch assemblies of the present invention can be installed to different types of electric products. The base and the switching member can connect with the replaceable switch cap which is chosen from the switch caps having various colors and shapes. The chosen switch caps have required shapes and colors so that the users can easily tell the individual switch assemblies and do not operate on the wrong switch assembly.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
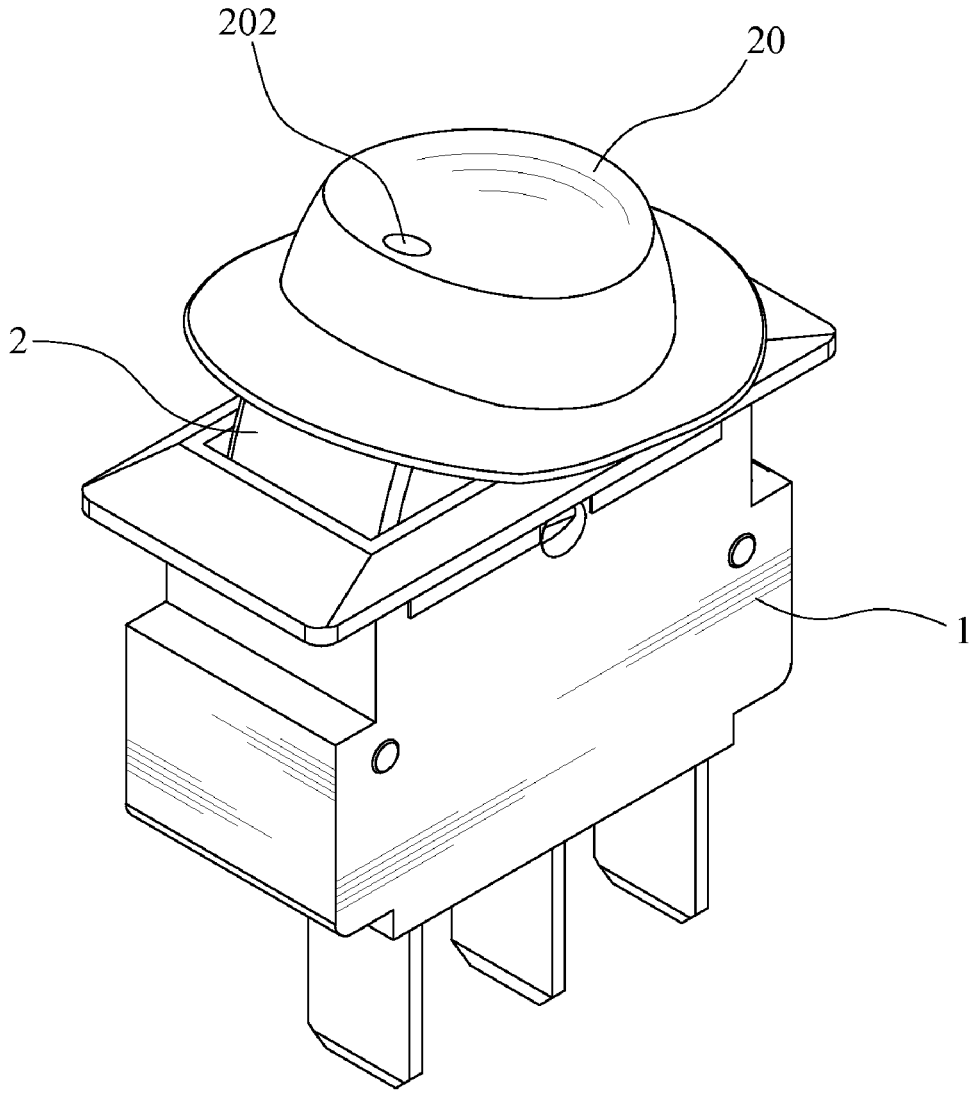
FIG. 1 is a perspective view showing a switch assembly in accordance with the present invention.

With reference to the drawings and in particular to FIGS. 1 to 4, a switch assembly in accordance with the present invention comprises a base 1, a switch member 2 and a switch cap 20. The base 1 has a recess 100 defined therein and two pivotal holes 10 defined in two sidewalls of the recess 100. A conductive plate 11 is located in the base 1 and includes a contact point 110.

Figure 4:
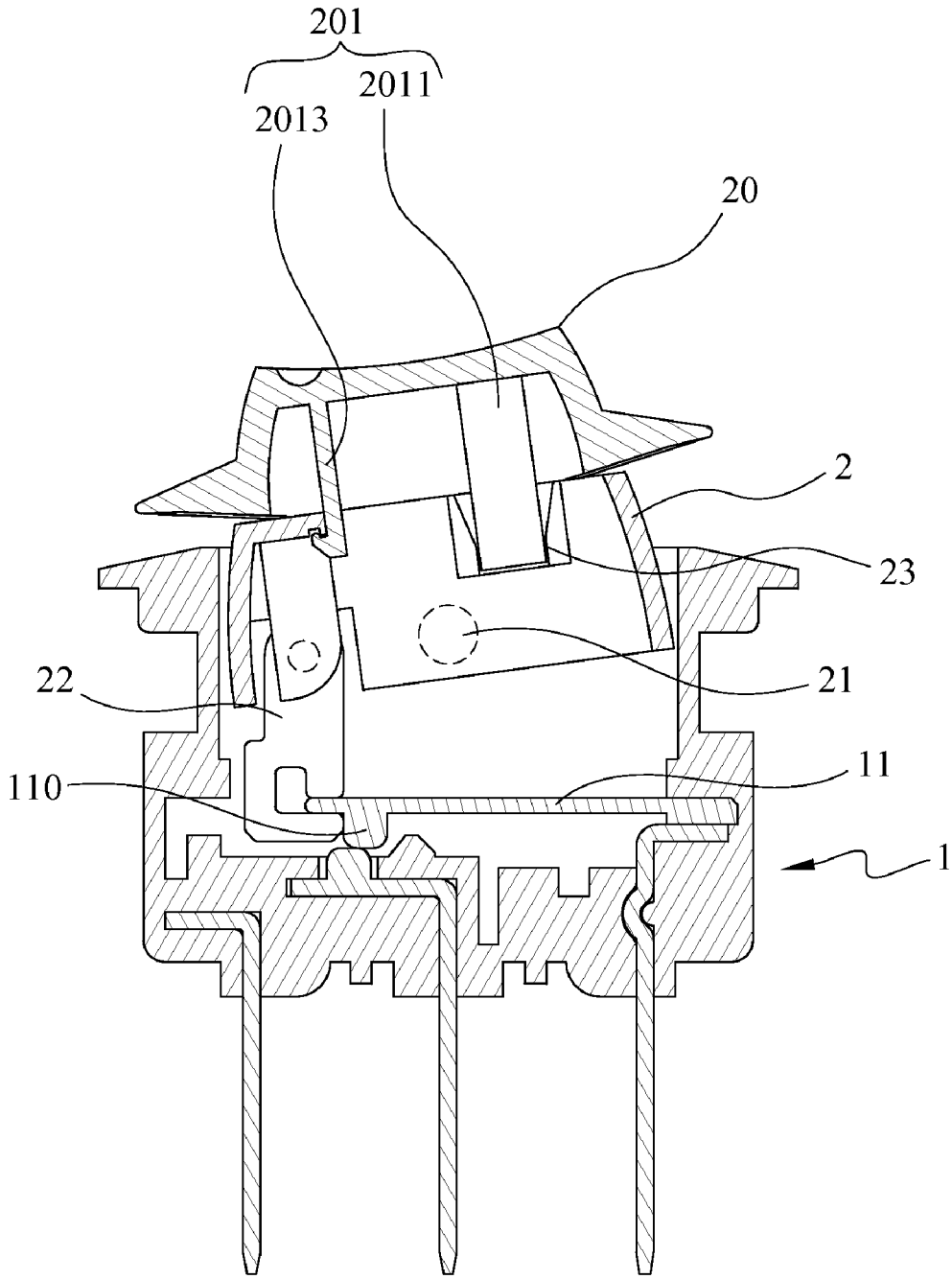
FIG. 4 is a cross sectional view showing the switch assembly of the present invention when a circuit is "ON"
Figure 5:
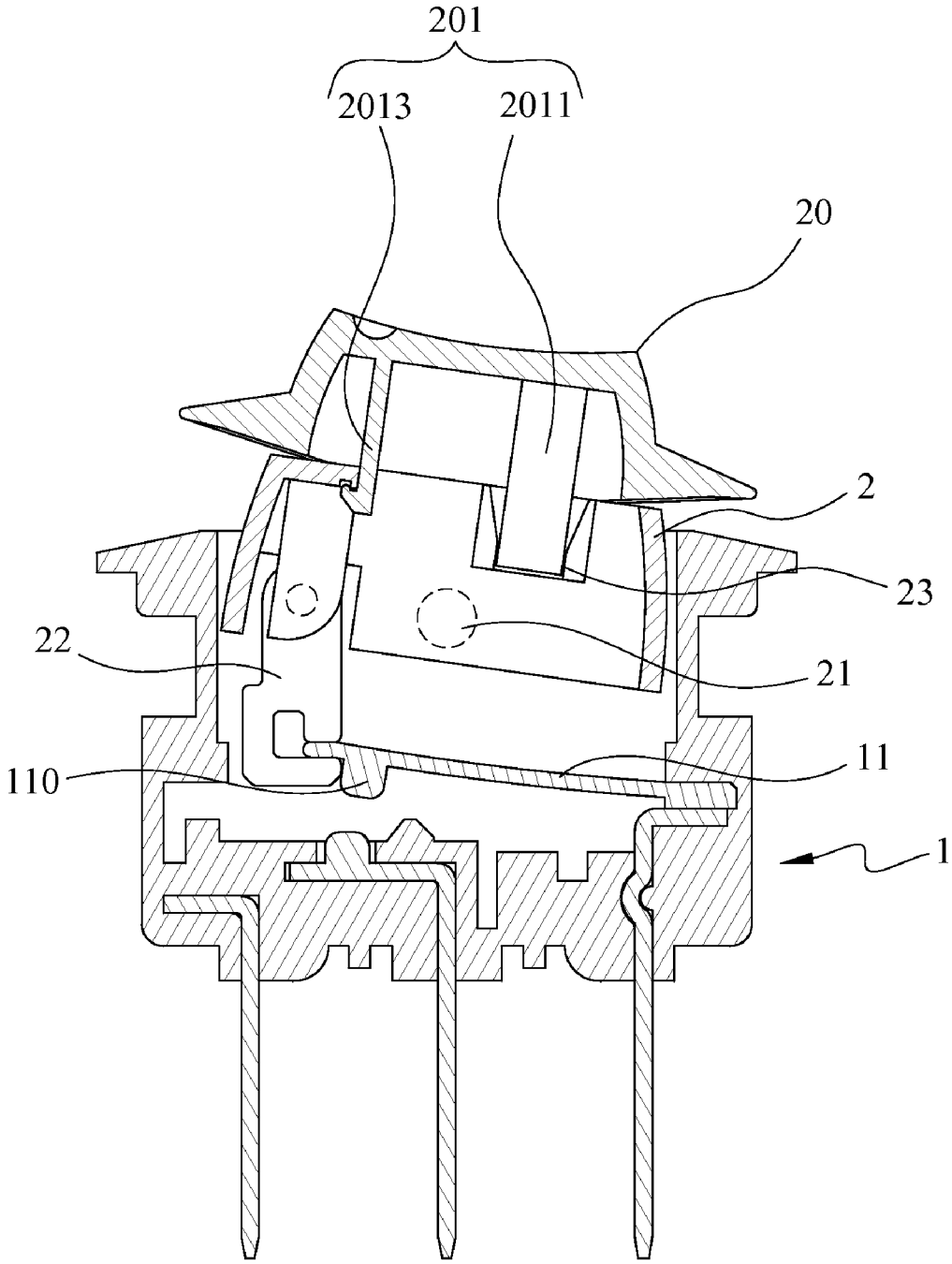
FIG. 5 is another cross sectional view of the switch assembly of the present invention when a circuit is "OFF".

Referring to FIGS. 4 and 5, the switch member 2 has two pivots 21 respectively disposed on two sides thereof and corresponding to the pivotal holes 10 of the base 1. The switch member 2 is located in the recess 100 and the two pivots 21 are pivotally connected with the pivotal holes 10 of the base 1 so that the switch member 2 is capable of pivotally rotating about the pivots 21. A pressing piece 22 is pivotally connected to the switch member 2. The switch member 2 has a plurality of engagement portions 23. When the switch member 2 is pivoted, the pressing piece 22 is moved to push the conductive plate 11 in the base 1 and the contact point 110 is electrically contacted with a terminal to form a closed circuit as shown in FIG. 4. On the contrary, when the contact point 110 is separated from the terminal, the circuit is cut off as shown in FIG. 5.

Figure 2:
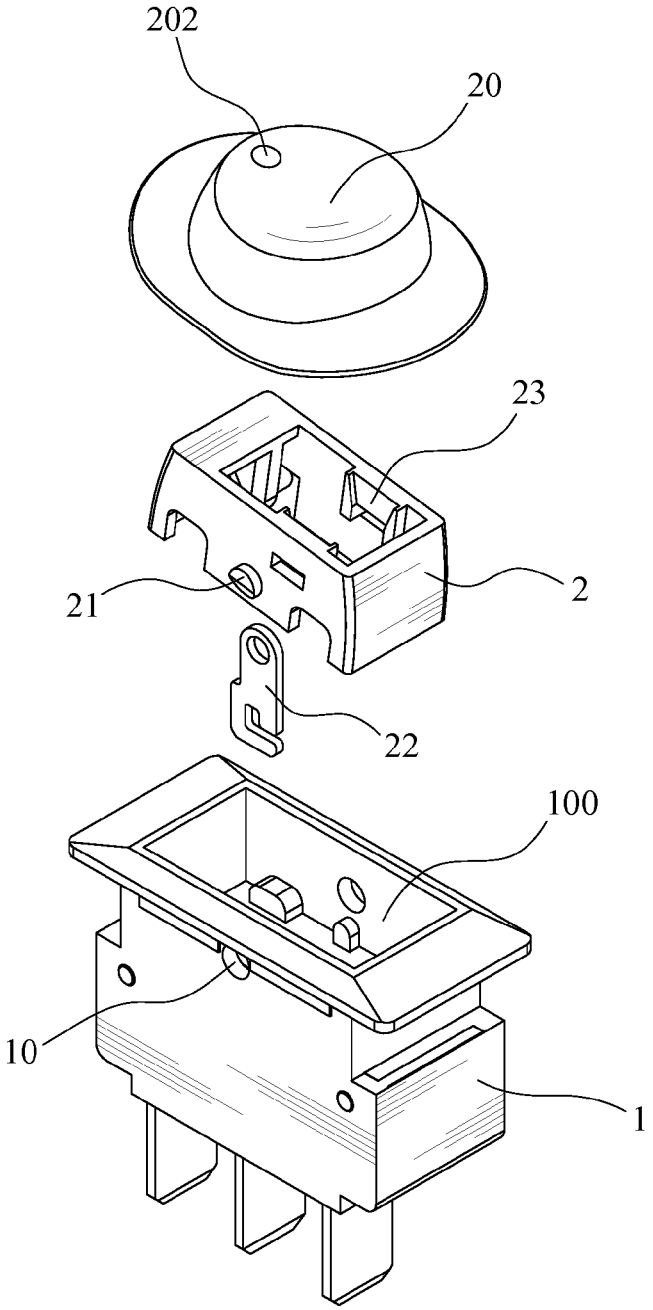
FIG. 2 is an exploded view showing the switch assembly according to the present invention.
Figure 3:
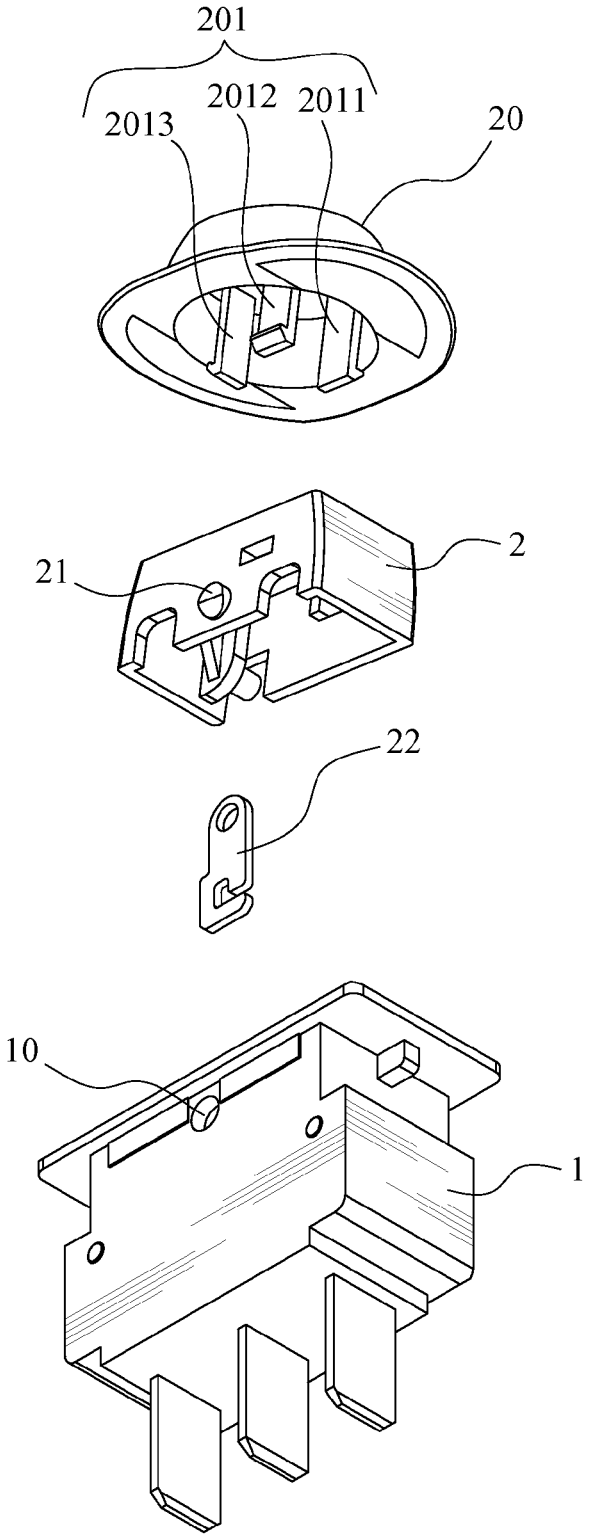
FIG. 3 is another exploded view of the switch assembly according to the present invention in another viewing angle.

The switch cap 20 has a hook unit 201 on a bottom thereof. The hook unit 201 includes a first hook 2011 and a second hook 2012 respectively disposed at two opposing sides of the switch cap 20, and at least one third hook 2013 disposed at another side perpendicular to the two opposing sides of the switch cap 20. The hook unit 201 is engaged with the engagement portions 23 of the switch member 2, thereby connecting the switch cap 20 with the switch member 2. Because of the connection between the third hook 2013 of the hook unit 201 and the switch member 2, the switch cap 20 is not loosened from the switch member 2 after being used for a period of time. As can be seen in FIGS. 2-4, the first hook 2011 and the second hook 2012 engage with the two engagement portions 23 formed on two opposite sides of the switch member 2, and the third hook 2013 engages with a third engagement portion formed on another side perpendicular to the two opposite sides of the switch member 2. The third hook 2013 cooperates with the first and second hooks 2011, 2012 and reinforces the connection between the switch cap 20 and the switch member 2. This arrangement overcomes the disadvantages of the conventional switch assembly disclosed in CN 2646858, which connection portions tend to shift relative to connection holes after a period of use and even disengage from the connection holes.

The switch cap 20 further has a Light Emitting Diode (LED) 202 and the pressing piece 22 is made of a conductive material. The LED 202 is electrically connected with the pressing piece 22 so that when the pressing piece 22 is contacted with the conductive plate 11, the LED 202 is activated to show the circuit is on.

When assembling the switch assembly according to the present invention, the base 1 and the switch member 2 are assembled to the electric product or the machine. Then, the desired switch cap 20 is chosen to be connected with the switch member 2 to meet different requirements of the electric products. For example, different shapes and colors of the switch caps 20 can correspond to different functions for easy recognition.

Referring to FIGS. 2 and 3, when the switch cap 20 is chosen, the first, second and third hooks 2011, 2012, 2013 of the hook unit 201 are hooked to the engagement portions 23 of the switch member 2. Therefore, the switch cap 20 can be easily and quickly connected to the switch member 2.

When the switch cap 20 is old or damaged and needs to be replaced, the hook unit 201 of the switch cap 20 is disengaged from the connection portions 23 of the switch member 2 and a new switch cap 20 is connected to the switch member 2 by engaging the hook unit 201 to the engagement portion 23.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A switch assembly, comprising:

a base having a recess defined therein and two pivotal holes defined in two sidewalls of the recess;

a switch member disposed in the recess and having two pivots on two opposite sides thereof, the pivots pivotally connected with the pivotal holes in the base, a pressing piece connected to the switch member, the switch member having first and second engagement portions formed on the two opposite sides and at least one third engagement portion formed on another side perpendicular to the two opposite sides of the switch member; and a switch cap having a hook unit on a bottom thereof;

wherein the hook unit includes a first hook, a second hook and at least one third hook, the first and second hooks are located at two opposing sides of the switch cap, the third hook is located at another side of the switch cap perpendicular to the two opposing sides of the switch cap, and the first, second and third hooks are engaged respectively with the first, second and third engagement portions of the switch member.

* * * * *